US005626546A

United States Patent [19]

Little

[11] Patent Number: 5,626,546

[45] Date of Patent: May 6, 1997

[54] WALL MOUNTED EXERCISE UNIT

[76] Inventor: James R. Little, 12700 New Providence Rd., Alpharetta, Ga. 30201

[21] Appl. No.: 654,220

[22] Filed: May 28, 1996

[51] Int. Cl.[6] ..... A63B 21/02

[52] U.S. Cl. ..... 482/129; 482/904; 482/123

[58] Field of Search ..... 482/121, 122, 482/123, 129, 904

[56] References Cited

U.S. PATENT DOCUMENTS

| | | | |
|---|---|---|---|
| 232,579 | 9/1880 | Weeks | 482/129 |
| 3,373,993 | 3/1968 | Oja et al. | 482/129 |
| 3,618,942 | 11/1971 | Bates | 482/129 |
| 4,402,504 | 9/1983 | Christian . | |
| 4,861,020 | 8/1989 | Soligny, Sr. | 482/129 |
| 4,909,505 | 3/1990 | Tee . | |
| 5,013,035 | 5/1991 | Nathaniel | 482/129 |
| 5,221,240 | 6/1993 | Mann et al. | 482/129 |
| 5,385,525 | 1/1995 | Davis . | |
| 5,431,617 | 7/1995 | Rattray . | |
| 5,468,205 | 11/1995 | McFall . | |
| 5,536,228 | 7/1996 | Tanner, Jr. | 482/129 |

*Primary Examiner*—L. Reichard

[57] ABSTRACT

The present invention relates to a wall mount exercise unit (10) comprising: a wall mount (12) comprises a wall mount left channel (12L) and a wall mount right channel (12K) which are securely attached to a wall with spacing complementary to the structural members located within the wall, the wall mount (12) functions to support adapters that facilitate exercising by an user. A series of universal blocks (14) functions to attach an adapter means and an elastic means to the wall mount (12). The first universal block (14A) is secured within wall mount (12) by the first universal block clevis pin (14AH) passing through the wall mount left channel aperture (12LAG) and the universal block tab aperture (14AG). The wall mount exercise unit (10) comprises a second pull adapter (118B) which is securely attached to an eighth universal block (14H) by a sixth elastic member (16F), the second pull adapter (118B) functions in conjunction with the first pull adapter (118A) to permit exercising both arms simultaneously. The wall mount exercise unit (10) further comprises a second curl adapter (220) which functions to permit curl style exercises. The wall mount exercise unit (10) consists of a third storage box (322) functioning as a seat and a storage means for the wall mount exercise unit (10) components.

10 Claims, 4 Drawing Sheets

WALL MOUNTED EXERCISE UNIT

BACKGROUND OF THE INVENTION

1. Field of the Invention

The present invention relates to exercise equipment. More particularly, the present invention relates to wall mounted adaptable exercise machine that operates with bungee cords as a resistance means and is mounted to a wall, thereby allowing the user to perform a wide variety of both cardiovascular and muscle strengthening exercises.

2. Description of the Prior Art

A variety of exercise machines, muscle toning apparatuses, specialized training machines, and workout systems have been developed for use in gyms, weight rooms, and workout locations. However, none of these exercise machines is adapted to fasten to a wall using standard wall stud spacing and provide a resistance mean comprising bungee cords. Further, none of the exercise machines mentioned in the prior art have a storage box which is also the shipping box.

Numerous innovations for Wall Mounted Exercise Unit have been provided in the prior art that are described as follows. Even though these innovations may be suitable for the specific individual purposes to which they address, they differ from the present invention as hereinafter contrasted.

In U. S. Pat. No. 5,468,205, titled Portable door mounted exercise apparatus, an exercise apparatus is disclosed having a pair of pulley support units mounted on a door by straps which vertically encircle the door. The support units are interconnected by a series of elastic bands, such as bungee cords that run vertical paths between the support units. The ends of the bands or cords are wrapped around pulleys and terminated such that a handle may be attached to each of the cords at either the top unit or the bottom unit. Various exercises are possible with one or two arms or legs by pulling on the cords with the handle. The apparatus is easily mounted or dismounted from any door or other vertically oriented and fixed-in-place partition and is small enough to fold and store in a small carrying case.

The present invention differs from the above described patented invention because the patented invention features pulleys removably fastened to a door by straps looped over the door at the top and bottom and fastened together at the back. The resistance device comprises custom length bungee cords. The present invention comprises a pair of rails which are securely fastened to a wall. The pair of rails are sized to cooperate with the standard wall stud spacing. The present invention uses standard bungee cords and has standard adjustable adapters secured by pins to a pair vertical rails. The present invention features a curl bar in addition to a ring device.

In U.S. Pat. No. 5,431,617, titled Resilient cord exercise device for attachment to a static structure an exercise device having a single central element anchored to a fixed structure with a plurality of elastic cables extending from an equal number of "S" type hooks to an elongated handle member. The elastic cables are attached at their ends opposite to the "S" hook attachment to the elongated handle which is covered with a foam type gripping material. The elastic cables attached to the elongated handle member are spaced apart so that the fingers of a human hand grasping the handle will pass between adjacent elastic cables. The elongated handle member is bent formed in a direction away from the handle attachment of the elastic cables at each end thereof with the central elastic cable attachment portion being slightly curved in a concave fashion in a direction facing the elastic cable attachment. Selected ones of the elastic cables can be removed or added at discrete locations along the concave portion of the elongated handle to vary the stress or pull required for particular body part being exercised.

The present invention differs from the above described patented invention because the patented invention has an elongated handle attached to a central fixed structure with elastic cables. The resistance is varied by changing the number of elastic cables. The present invention comprises a pair of rails which are securely fastened to a wall. The pair of rails are sized to cooperate with the standard wall stud spacing. The present invention uses standard bungee cords and has standard adjustable adapters secured by pins to a pair vertical rails. The present invention features a curl bar in addition to a ring device.

In U.S. Pat. No. 5,385,525, titled Wall mounted shower exercise machine an exercise machine is constructed with an elongate rectangular flamework having spaced apart vertical legs joined by a plurality of horizontal cross braces. Suction cup anchors are attached to the elongate rectangular flamework approximately at the four corners and at midsection of the legs for anchoring the shower exercise machine to nonporous wall surfaces such as tile surfaces or other nonporous wall surfaces of a shower or bath. First and second stretchable resistance cords are anchored at one end to the rectangular framework at the midsection of the legs and terminate at the other ends in hand grips. The stretchable resistance cords pass through pulleys. Pulley supports are provided for supporting the pulleys at different locations on the rectangular framework for example at the top corners or the bottom corners of the rectangular framework for changing the direction of the handle grips and direction of stretching of the cords for exercising different muscles. The exercise machine can be disassembled into a smaller package for transport. A set of adhesively backed nonporous surface decals are provided for installing the exercise machine on a porous wall surface and for use of the exercise machine at any desired location.

In U.S. Pat. No. 4,909,505, titled Selectively Connectable Elastomeric Exercise Apparatus, invented by Virgil J. Tee, at least one elastomeric tube formed in a loop with rings threaded on the loop to receive a connectable hand grip, a connectable foot strap, and a connectable door stop. The hand grip, the foot strap, and the door stop each include a woven fabric ribbon which threads through at least one elongated rigid tube, the ribbon connected at its ends to form a large loop to receive the rigid tube and a smaller second loop to receive a snap buckle. Various combinations of the elastic loops, the hand grip, the door stop, and the foot strap may be interconnected to permit the exerciser to perform a variety of exercises to fully work out the upper body, the abdomen, and the legs.

In U.S. Pat. No. 4,402,504, titled Wall Mounted Adjustable Exercise Device, invented by Robert J Christian, a multiple purpose wall mounted adjustable exercise device has an upstanding elongated frame including two upright spaced parallel guide posts and an upper pulley and a lower a lower pulley attached to the upper and lower portions of the frame, respectively. A resistance means operatively connected to the frame provides an exercising force in response to exercising motions of the user. A two-ended cable is trained around the upper and lower pulleys with its ends connected to the resistance means. A grip slidably attached to an intermediate portion of the cable is trained around and between two guide pulleys attached to a carriage that is carried by the frame. The length of the working loop remains substantially constant when not pulled, regardless of the height of the carriage. The resistance means may comprise resilient elastic straps, coiled springs or weights.

Numerous innovations for Wall Mounted Exercise Unit have been provided in the prior art that are adapted to be used. Even though these innovations may be suitable for the specific individual purposes to which they address, they would not be suitable for the purposes of the present invention as heretofore described.

SUMMARY OF THE INVENTION

The importance of regular exercise for building and maintaining strength and endurance as well as general health is well known. The age in which we live with its modern convinces and comfortable life style has lead to a sedentary existence necessitating exercise to maintain health. This has lead to the development of devices to facilitate exercise such as tread ills, stationary bicycles, stair steppers and weight lifting machines. The adore mentioned machines require significant, dedicated floor space which is occupied whether or not the device is in use. Prior art exists wherein the floor space problem in weight machines has been addressed by mounting a portion of the machine on a wall and adapting attachments to fold or be removed for storage else where. Exercise devices provide a resistance for the user to work against which consists of dead weights, damping mechanism, or elastic elements.

The present invention requires little space as it attaches to a wall and folds flat against the wall when not in use. A storage box is included in which to put the attachments for storage. Additionally the storage box is also the shipping box and all component parts are designed to fit with in the storage box prior to assembly at the users site.

The use of elastic elements is refined to use elastic elements commonly identified as bungee 'cords'. Common connection devices are adapted to cooperate with the attachments, storage box and elastic elements to fasten each to a pair of vertical rails.

The types of problems encountered in the prior art are the weight machines require significant floor space, are heavy complex and expensive.

In the prior art, unsuccessful attempts to solve this problem were attempted namely attaching all or part of the machine to a wall and substituting elastic members for the weights. The resulting devices continued to be expensive. However, the problem was solved by the present invention because it is simpler, uses standard elastic members and does not have a pulley system and makes use of multiple standard components which reduce manufacturing costs.

Innovations within the prior art are rapidly being exploited with the proliferation of health spas and the desire of individuals to exercise at home on an individual schedule.

The present invention went contrary to the teaching of the art by incorporating standard elastic members rather than custom elastic members.

The present invention solved a long felt need for a simple, low cost exercise machine that replicates the benefits of weight lifting with out requiring dedicated floor space when not in use.

A synergistic effect was produced utilizing the present invention due to the design of the present invention in which all of the component parts fit within the storage box for shipment to the end customer.

Accordingly, it is an object of the present invention to provide a cost effective resistance exercise machine for the consumer market which requires little floor space More particularly, it is an object of the present invention to provide resistance exercise training to individuals.

In keeping with these objects, and with others which will become apparent hereinafter, one feature of the present invention resides, briefly stated, in the use of standard bungee cord to provide resistance to the user.

When the Wall Mount Exercise Unit is designed in accordance with the present invention, a simple cost effective means of exercising is provided.

In accordance with another feature of the present invention, the use of common connector to fasten attachments to a pair of vertical rails.

Another feature of the present invention is that a storage box is included to contain the attachments and provide a shipping container.

Yet another feature of the present invention is that standard bungee cords are used to provide resistance to the user.

The novel features which are considered characteristic for the invention are set forth in the appended claims. The invention itself, however, both as to its construction and its method of operation, together with additional objects and advantages thereof, will be best understood from the following description of the specific embodiments when read and understood in connection with the accompanying drawing(s).

BRIEF LIST OF REFERENCE NUMERALS UTILIZED IN THE DRAWING

10—wall mount exercise unit (10)
12—wall mount (12)
12L—wall mount left channel (12L)
12LA—wall mount left channel top (12LA)
12LAA—wall mount left channel slot (12LAA)
12LAB—wall mount left channel front left member (12LAB)
12LAC—wall mount left channel left side member (12LAC)
12LAD—wall mount left channel back member (12LAD)
12LAE wall mount left channel right side member (12LAE)
12LAF—wall mount left channel front right member (12LAF)
12LAG—wall mount left channel aperture (12LAG)
12LB—wall mount left channel bottom (12LB)
12R—wall mount right channel (12R)
12RA—wall mount right channel top (12RA)
12RAA—wall mount right channel slot (12RAA)
12RAB—wall mount right channel front left member (12RAB)
12RAC—wall mount right channel left side member (12RAC)
12RAD—wall mount right channel back member (12RAD)
12RAE—wall mount right channel right side member (12RAE)
12RAF—wall mount right channel front right member (12RAF)
12RAG—wall mount right channel aperture (12RAG)
12RB—wall mount right channel bottom (12RB)
14—universal block (14)
14A—first universal block (14A)
14AA—first universal block cube top face (14AA)
14AB—first universal block cube side face (14AB)
14AC—first universal block cube aperture (14AC)
14AD—first universal block cube front face (14AD)
14AE—first universal block tab (14AE)
14AG—first universal block tab aperture (14AG)
14AH—first universal block clevis pin (14AH)
14AHA—first universal block clevis pin head (14AHA)

14AHB—first universal block clevis pin shaft (14AHB)
14AHC—first universal block clevis pin aperture (14AHC)
14AHD—first universal block retaining pin (14AHD)
14B—second universal block (14B)
14C—third universal block (14C)
14D—fourth universal block (14D)
14E—fifth universal block (14E)
14F—sixth universal block (14F)
14G—seventh first universal block (14G)
14H—eighth universal block (14H)
14I—ninth universal block (14I)
14J—tenth universal block (14J)
16A—first elastic member (16A)
16AA—first elastic member universal block fastener (16AA)
16AB—first elastic member first elastic(16AB)
16AC—first elastic member adapter fastener (16AC)
16B—second elastic member (16B)
16C—third elastic member (16C)
16D—fourth elastic member (16D)
16E—fifth elastic member (16E)
16F—sixth elastic member (16F)
FIRST EMBODIMENT
118A—first pull adapter (118A)
118AA—first handle (118AA)
118AAA—first handle left member (118AAA)
118AAB—first handle transverse member (118AAB)
118AAC—first handle right member (118AAC)
118AAD—first handle grip (118AAD)
118AAE—first handle cable connector (118AAE)
118AB—first cable (118AB)
118AC—first eye (118AC)
118B—second pull adapter (118B)
SECOND EMBODIMENT
220—second curl adapter (220)
220A—second left bar (220A)
220AA—second left bar transverse member (220AA)
220AB—second left bar left member (220AB)
220AC—second left bar aperture (220AC)
220AD—second left bar left member aperture (220AD)
220AE—second left bar attachment (220AE)
220AEA—second left bar attachment upper aperture (220AEA)
220AEB—second left bar attachment lower aperture (220AEB)
220B—second right bar (220B)
220BA—second right bar transverse member (220BA)
220BB—second right bar left member (220BB)
220BC—second right bar aperture (220BC)
220BD—second right bar left member (220BD)
220BE—second right bar attachment (220BE)
220BEA—second right bar attachment upper aperture (220BEA)
220BEB—second right bar attachment lower aperture (220BEB)
220C—curl bar (220C)
THIRD EMBODIMENT
322—third storage box (322)
322A—third container (322A)
322B—third top (322B)
322BA—third left attachment (322BA)
322BAA—third left attachment left tab (322BAA)
322BAB—third left attachment right tab (322BAB)
322BAC—third left attachment left tab aperture (322BAC)
322BAD—third left attachment right tab aperture (322BAD)
322BB—third right attachment (322BB)
322BBA—third right attachment left tab (322BBA)
322BBB—third right attachment right tab (322BBB)
322BBC—third right attachment left tab aperture (322BBC)
322BBD—third right attachment right tab aperture (322BBD)
322C—third lid (322C)

BRIEF DESCRIPTION OF THE PREFERRED EMBODIMENT

DETAILED DESCRIPTION OF THE PREFERRED EMBODIMENT

Figure 1:
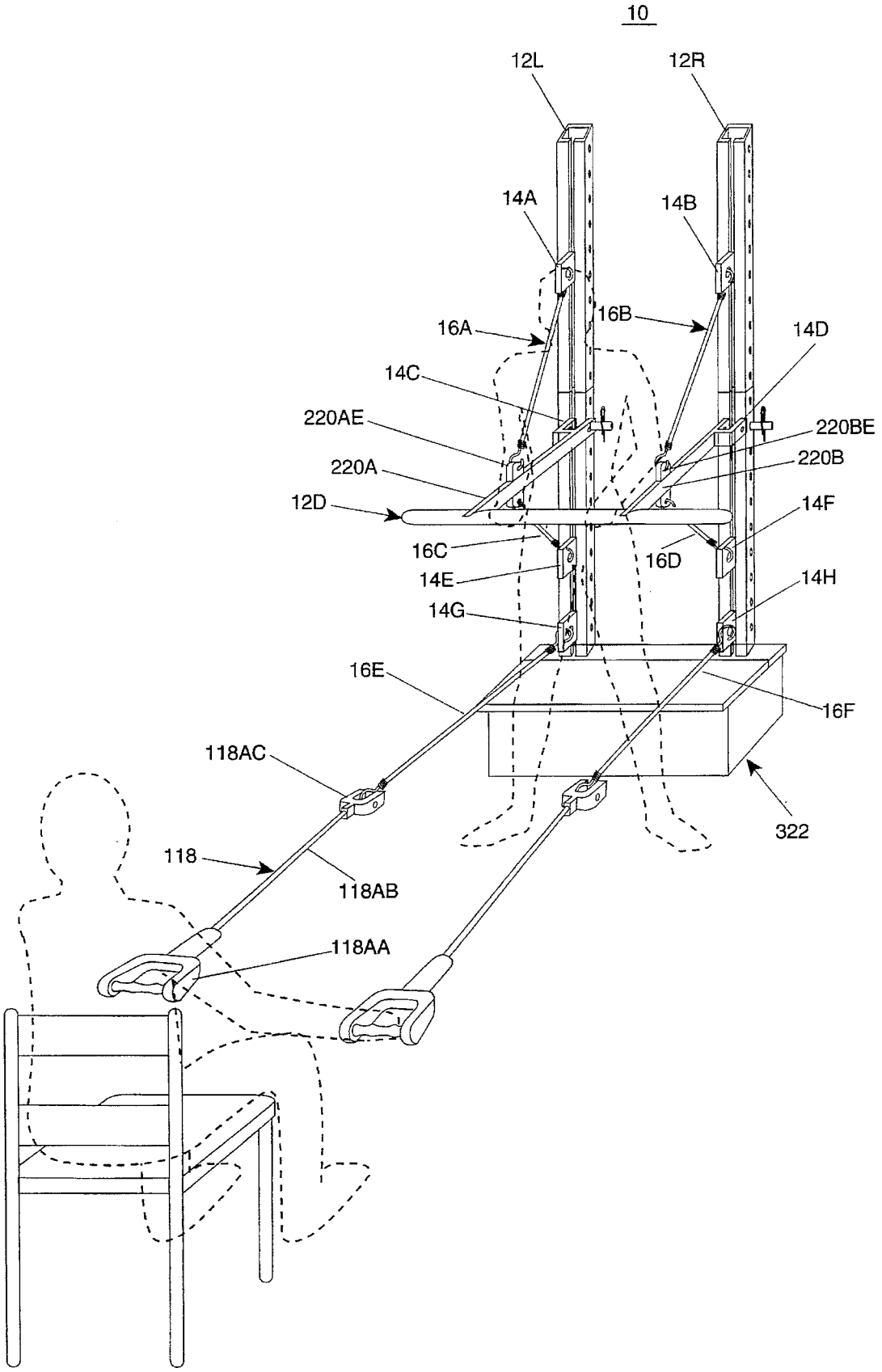
FIG. 1 is a perspective view of a wall mount exercise unit.

Firstly referring to FIG. 1 which is a perspective view of a wall mount exercise unit (10) having the following features: wall mount exercise unit (10), wall mount (12), wall mount left channel (12L), wall mount right channel (12R), universal block (14), first universal block (14A), second universal block (14B), third universal block (14C), fourth universal block (14D), fifth universal block (14E), sixth universal block (14F), seventh first universal block (14G), eighth universal block (14H), ninth universal block (14I), tenth universal block (14J), first elastic member (16A), second elastic member (16B), third elastic member (16C), fourth elastic member (16D), fifth elastic member (16E), sixth elastic member (16F), first pull adapter (118A), first handle (118AA), first cable (118AB), first fork (11SAC), second pull adapter (118B), second curl adapter (220), second left bar (220A), second right bar (220B), second left bar attachment (220AE), second right bar attachment (220BE), curl bar (220C), third storage box (322), third right attachment (322BB), third left attachment (322BA)

A wall mount exercise unit (10) comprises: a wall mount (12) securely fastened to a wall. The wall mount (12) comprises: a wall mount left channel (12L) and a wall mount right channel (12R). The wall mount left channel (12L) slidably contains a group of first universal blocks (16A, 16C, 16F) which function as fastening points. The wall mount right channel (12R) slidably contains a group of first universal blocks (16B, 16D, 16E) which function as fastening points.

The wall mount left channel (12L) comprises a first universal block (14A) which is securely fastened to one distal end of a first elastic member (16A). The opposite distal end of the first elastic member (16A) is securely fastened to an upper distal end of a second left bar attachment (220AE). The second left bar attachment (220AE) is securely fastened to a second left bar (220A). The inner distal end of the second left bar (220A) is rotatably attached to a third universal block (14C). The outer distal end of the second left bar (220A) is securely fastened to a left distal end of a curl bar (220C). The lower distal of the second left bar attachment (220AE) is removable fastened to an upper distal end of a third elastic member (16C). The lower distal end of the third elastic member (16C) is securely and removably attached to a fifth universal block (14E).

The right distal end of the curl bar (220C) is securely attached to an outer distal end of a second right bar (220B).

The inner distal end of the second right bar (220B) is rotatably attached to a fourth universal block (14D). A second right bar attachment (220BE) is securely attached to the second right bar (220B). The upper distal end of the second right bar (220B) is securely and removably attached to a lower distal end of a second elastic member (16B). The upper distal end of the second elastic member (16B) is removably and securely attached to a second universal block (14B). The lower distal end of the second right bar attachment (220BE) is removably attached to an upper distal end of a fourth elastic member (16D) which is removably attached at the opposite distal end to a sixth universal block (14F).

The second curl adapter (220) functions in cooperation with the elastic members (14A, 14B, 14C, 14D, 14E, 14F), first universal blocks (16A, 16B, 16C, 16E, 16F) and the user to provide resistance upwardly and downwardly while the user is exercising.

The wall mount left channel (12L) further comprises a seventh first universal block (14G) which is securely attached to an inner distal end of a fifth elastic member (16E). The outer distal end of the fifth elastic member (16E) is securely attached to a first eye (118AC) which is securely attached to the inner distal end of a first cable (118AB). The outer distal end of the first cable (118AB) is securely attached to a first handle (118AA). The first eye (118AC), first cable (118AB) and first handle (118AA) comprise a first pull adapter (118A). A second pull adapter (118B) is securely attached to a sixth elastic member (16F) thence to an eighth universal block (14H). The eighth universal block (14H) is movably and securely attached to the wall mount right channel (12R). The first pull adapter (118A) and second pull adapter (118B) function to provide resistance to an user while exercising the upper portion of the body.

A third storage box (322) comprises a third left attachment (322BA) which is securely attached to a ninth universal block (14I) which his securely attached to a wall mount left channel (12L). The third storage box (322) further comprises a third right attachment (322BB) which is securely attached to a tenth universal block (14J) which is securely attached to a wall mount right channel (12R). The third right attachment (322BB) and third left attachment (322BA) function to hold the third storage box (322) off the ground.

Figure 2:
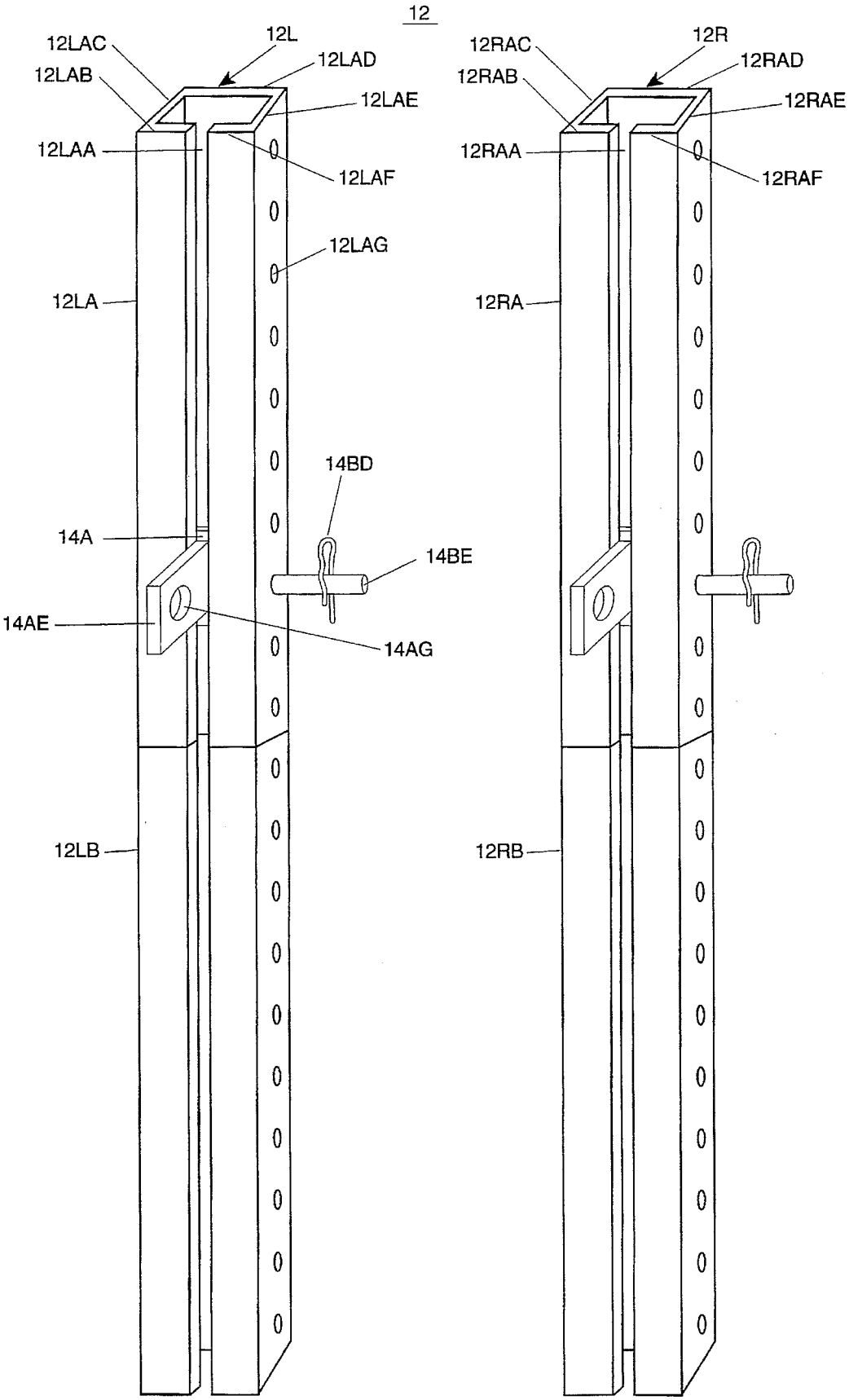
FIG. 2 is a perspective view of a wall mount.

Secondly referring to FIG. 2 which is a perspective view of a wall mount (12) having the following features: wall mount left channel (12L), wall mount left channel top (12LA), wall mount left channel slot (12LAA), wall mount left channel front left member (12LAB), wall mount left channel left side member (12LAC), wall mount left channel back member (12LAD), wall mount left channel right side member (12LAE), wall mount left channel front right member (12LAF), wall mount left channel aperture (12LAG), wall mount left channel bottom (12LB), wall mount right channel (12R), wall mount right channel top (12RA), wall mount right channel slot (12RAA), wall mount right channel front left member (12RAB), wall mount right channel left side member (12RAC), wall mount right channel back member (12RAD), wall mount right channel right side member (12RAE), wall mount right channel front right member (12RAF), wall mount right channel aperture (12RAG), wall mount right channel bottom (12RB), universal block (14), universal block cube (14A), first universal block cube side face (14AB), first universal block cube aperture (14AC), first universal block cube front face (14AD), first universal block tab (14AE), first universal block tab aperture (14AG), first universal block clevis pin (14AH), first universal block clevis pin head (14AHA), first universal block clevis pin shaft (14AHB), first universal block clevis pin aperture (14AHC), first universal block retaining pin (14AHD), universal block clevis pin shark (14BB), universal block clevis pin aperture (14BC), and universal block retaining pin (14BD).

The wall mount (12) comprises a wall mount left channel (12L) securely fastened to a wall and a wall mount right channel (12R) securely fastened to a wall. The wall mount left channel (12L) and wall mount right channel (12R) are mounted a distance apart that cooperates with the spacing of structural members with in the wall. The wall mount left channel (12L) comprises a wail mount left channel top (12LA) which is mating proximally to a wall mount left channel bottom (12LB). The a wall mount left channel top (12LA) and wall mount left channel bottom (12LB) are sized to fit within the third storage box (322) for shipping.

The wall mount left channel top (12LA) comprises a wall mount left channel slot (12LAA) juxtaposed between a wall mount left channel front left member (12LAB) and a wall mount left channel front right member (12LAF). The wall mount left channel front left member (12LAB) is perpendicularly attached to one distal end of a wall mount left channel left side member (12LAC). The opposite distal end of the wall mount left channel left side member (12LAC) is perpendicularly attached to one distal end of a wall mount left channel back member (12LAD). The opposite distal end of the wall mount left channel back member (12LAD) is perpendicularly attached to one distal end of a wall mount left channel right side member (12LAE). The opposite distal end of the wall mount left channel right side member (12LAE) is attached perpendicularly to one distal end of a wall mount left channel front right member (12LAF).

The wall mount left channel (12L) functions to slidable and securely hold the first universal blocks (14A, 14C, 14E, 14G, 14I,). The universal block cube (14A) is shown having an universal block tab (14AE) protruding through the wall mount left channel slot (12LAA).

The first universal block (14A) comprises a first universal block cube top face (14AA) attached perpendicularly to a first universal block cube side face (14AB). The first universal block cube side face (14AB) has a first universal block cube aperture (14AC) centrally located and passing through to the opposite side. The first universal block cube side face (14AB) is further attached to a first universal block cube front face (14AD) along a front edge. The first universal block cube front face (14AD) has a first universal block tab (14AE) attached perpendicularly, along a central vertical line, the first universal block tab (14AE) protrudes through the wall mount left channel slot (12LAA) functioning to permit attachment of adapters to a first universal block tab aperture (14AG).

The first universal block (14A) is secured within the wall mount left channel (12L) by a first universal block clevis pin (14AH) passing through the wall mount left channel aperture (12LAG) and the universal block tab aperture (14AG). The first universal block clevis pin (14AH) comprises a first universal block clevis pin head (14AHA) securely attached to one distal end of a first universal block clevis pin shaft (14AHB). The opposite distal end of the first universal block clevis pin shaft (14AHB) comprises a first universal block clevis pin aperture (14AHC) functioning to removably secure a first universal block retaining pin (14AHD) which prevents the first universal block clevis pin (14AH) from being inadvertently dislodged.

The wall mount right channel (12R) comprises a wall mount right channel top (12RA) and a wall mount right channel bottom (12RB) securely fastened to a wall.

The wall mount right channel top (12RA) and wall mount right channel bottom (12RB) are sized to fit within the third storage box (322) for shipping.

The wall mount right channel top (12RA) comprises a wall mount right channel slot (12RAA) juxtaposed between a wall mount right channel front left member (12RAB) and a wall mount right channel front right member (12RAF). The wall mount right channel front left member (12RAB) is perpendicularly attached to one distal end of a wall mount right channel left side member (12RAC). The opposite distal end of the wall mount right channel left side member (12RAC) is perpendicularly attached to one distal end of a wall mount right channel back member (12RAD). The opposite distal end of the wall mount right channel back member (12RAD) is perpendicularly attached to one distal end of a wall mount right channel right side member (12RAE). The opposite distal end of the wall mount right channel right side member (12RAE) is attached perpendicularly to one distal end of a wall mount right channel from right member (12RAF).

The wall mount right channel (12R) functions to slidable and securely hold the first universal blocks (14B, 14D, 14F, 14H, 14J,). The universal block cube (14A) is shown having an universal block tab (14AE) protruding through the wall mount right channel slot (12RAA).

Figure 3:
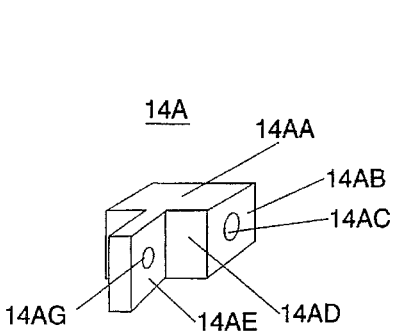
FIG. 3 is a perspective view of an universal block.

Thirdly referring to FIG. 3 which is a perspective view of a first first universal block (14A), having the following features: first universal block cube top face (14AA), first universal block cube side face (14AB), first universal block cube aperture (14AC), first universal block cube front face (14AD), first universal block tab (14AE), first universal block tab aperture (14AG), first universal block clevis pin (14AH), first universal block clevis pin head (14AHA), first universal block clevis pin shaft (14AHB), first universal block clevis pin aperture (14AHC), and first universal block retaining pin (14AHD).

The first universal block (14A) comprises the first universal block cube top face (14AA) attached perpendicularly to the first universal block cube side face (14AB). The first universal block cube side face (14AB) has the first universal block cube aperture (14AC) centrally located and passing through to the opposite side. The first universal block cube side face (14AB) is further attached to the first universal block cube front face (14AD) along the front edge. The first universal block cube from face (14AD) has the first universal block tab (14AE) attached perpendicularly, along the central vertical line, the first universal block tab (14AE) protrudes through the wall mount left channel slot (12LAA) functioning to permit attachment of adapters to the first universal block tab aperture (14AG).

The first universal block (14A) is secured within the wall mount left channel (12L) by the first universal block clevis pin (14AH) passing through the wall mount left channel aperture (12LAG) and the universal block tab aperture (14AG). The first universal block clevis pin (14AH) comprises the first universal block clevis pin head (14AHA) securely attached to one distal end of the first universal block clevis pin shaft (14AHB). The opposite distal end of the first universal block clevis pin shaft (14AHB) comprises the first universal block clevis pin aperture (14AHC) functioning to removably secure the first universal block retaining pin (14AHD) which prevents the first universal block clevis pin (14AH) from being inadvertently dislodged.

Figure 4:
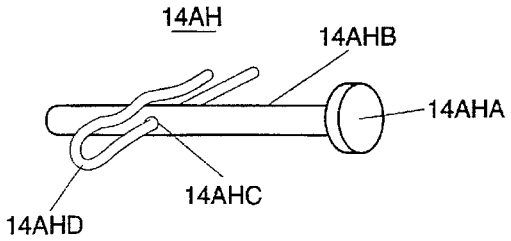
FIG. 4 is a perspective view of an universal block clevis pin.

Referring now to FIG. 4 which is a perspective view of a first universal block clevis pin (14AH) having the following features: first universal block clevis pin (14AH), first universal block clevis pin head (14AHA), first universal block clevis pin shaft (14AHB), first universal block clevis pin aperture (14AHC), and first universal block retaining pin (14AHD).

The first universal block clevis pin (14AH) comprises the first universal block clevis pin head (14AHA) securely attached to one distal end of the first universal block clevis pin shaft (14AHB). The opposite distal end of the first universal block clevis pin shaft (14AHB) comprises the first universal block clevis pin aperture (14AHC) functioning to removably secure the first universal block retaining pin (14AHD) which prevents the first universal block clevis pin (14AH) from being inadvertently dislodged.

Figure 5:
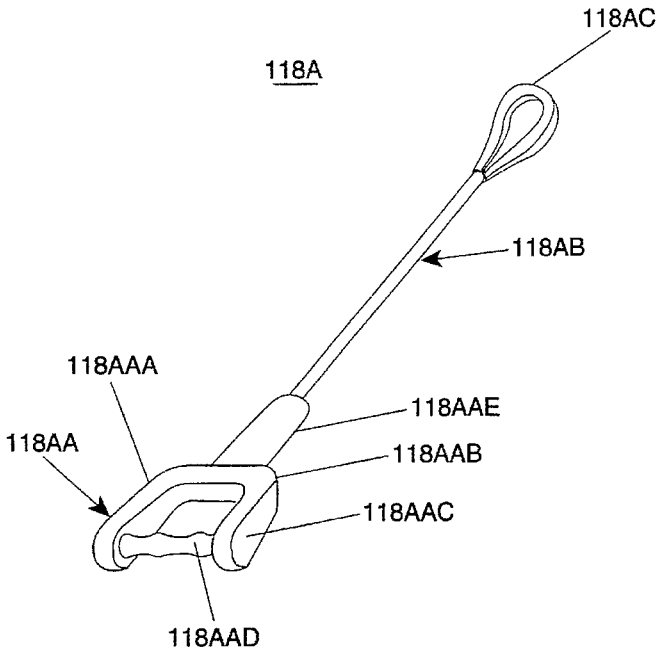
FIG. 5 is a perspective view of a first pull adapter.

Now referring to FIG. 5 which is a perspective view of a first pull adapter (118A) having the following features: first pull adapter (118A), first handle (118AA), first handle left member (118AAA), first handle transverse member (118AAB), first handle right member (118AAC), first handle grip (118AAD), first handle cable connector (118AAE), first cable (118AB), and first loop 118AC).

A first pull adapter (118A) comprising a first handle (118AA) comprises a first handle left member (118AAA) securely attached orthogonally to one distal end of a first handle transverse member (118AAB). The first handle transverse member (118AAB) to the opposite distal end is attached orthogonally to one distal end of a first handle right member (118AAC). The first handle right member (118AAC) at the opposite distal end is attached to one distal end of a first handle grip (118AAD). The first handle grip (118AAD) is securely attached at the opposite distal end to the handle left member (118AAA). The first handle grip (118AAD) maybe securely and rotationally attached to the respective distal end of the handle left member (118AAA) and the first handle right member (118AAC). The first handle (118AA) functions to provide a handhold for an user. The first handle transverse member (118AAB) further at its midpoint is securely attached to a first handle cable connector (118AAE) which functions to securely attach the first handle (118AA) to one distal end of a first cable (118AB). The opposite distal end of the first cable (118AB) is formed into a first loop 118AC) functioning to attach the first pull adapter (118A) to a fifth elastic member (16E). The first pull adapter (118A) and the fifth elastic member (16E) function together to provide resistance to an user.

Figure 6:
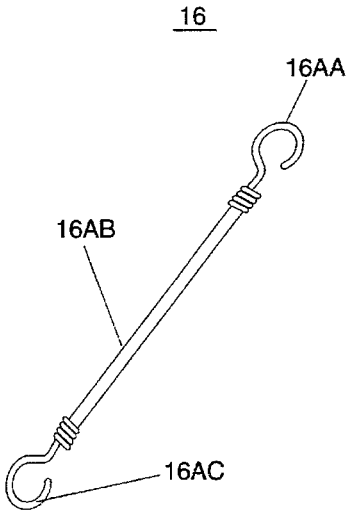
FIG. 6 is a perspective view of an elastic member.

Referring now to FIG. 6 which is a perspective view of an elastic member having the following features: first elastic member (16A), first elastic member first elastic (16AA), first elastic member universal block fastener (16AB), and first elastic member adapter fastener (16AC).

The first elastic member (16A) comprising a first elastic member universal block fastener (16AA) functions to attach the first elastic member (16A) to an universal block (14) selected from the group of first universal blocks (14A, 14B, 14C, 14D, 14E, 14F, 14G, 14H, 14I). The a first elastic member universal block fastener (16AA) is securely attached to proximal end of a first elastic member first elastic (16AB). The distal end of the first elastic member first elastic (16AB) is securely attached to a first elastic member adapter fastener (16AC). The first elastic member adapter fastener (16AC) functions to attach the first elastic member (16A) to the second curl adapter (220) and first pull adapter (118A).

Figure 7:
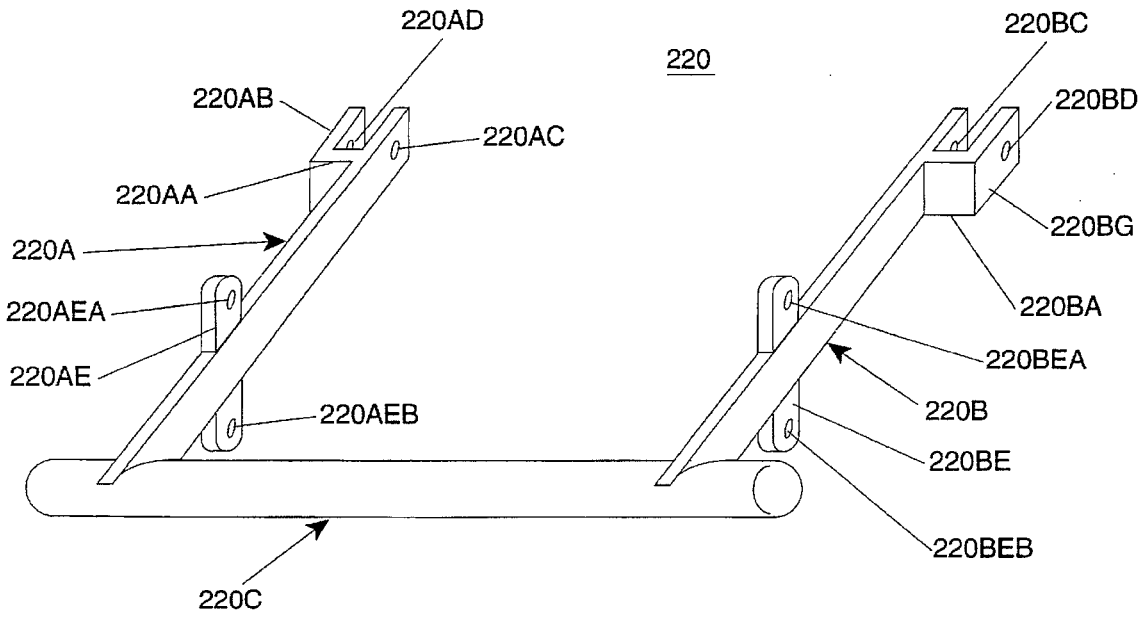
FIG. 7 is a perspective view of a second curl adapter.

Referring now to FIG. 7 which is a perspective view of a second curl adapter having the following features: second curl adapter (220), second left bar (220A), second left bar transverse member (220AA), second left bar left member (220AB), second left bar aperture (220AC), second left bar left member aperture (220AD), second left bar attachment (220AE), second left bar attachment upper aperture (220AEA), second left bar attachment lower aperture (220AEB), second right bar (220B), second right bar transverse member (220BA), second right bar left member (220BB), second right bar aperture (220BC), second right bar left member (220BD), second right bar attachment (220BE), second right bar attachment upper aperture (220BEA), second right bar attachment lower aperture (220BEB), and curl bar (220C).

A second curl adapter (220) comprises a second left bar (220A) which is securely attached at one distal end to a proximal end of a second left bar transverse member (220AA). A distal end of the second left bar transverse member (220AA) is securely attached to a proximal end of a second left bar left member (220AB). The second left bar (220A) comprises a second left bar aperture (220AC). The second left bar transverse member (220AA) comprises a second left bar left member aperture (220AD). The second left bar aperture (220AC) and second left bar left member aperture (220AD) function to slidable and removably secure the second left bar (220A) to a third universal block (14C) by a first universal block clevis pin (14AH).

The second left bar (220A) comprises a second left bar attachment (220AE) which comprises a second left bar attachment upper aperture (220AEA). The second left bar attachment upper aperture (220AEA) functions to secure the second left bar attachment (220AE) to the first elastic member (16A). The second left bar attachment (220AE) further comprises a second left bar attachment lower aperture (220AEB) which functions to secure the second left bar attachment (220AE) to the third elastic member (16C).

The second curl adapter (220) further comprises a second right bar (220B) which is perpendicularly attached to a proximal end of a second right bar transverse member (220BA). The distal end of the second right bar transverse member (220BA) is securely attached to a proximal end of a second right bar left member (220BB). The a second right bar (220B) comprises a second right bar aperture (220BC). The second right bar left member (220BB) comprises a second right bar left member (220BD). The second right bar aperture (220BC) and second right bar left member (220BD) function to slidable and removably secure the second right bar (220B) to a fourth universal block (14D) by a first universal block clevis pin (14AH).

The second right bar (220B) comprises a second right bar attachment (220BE) which comprises a second right bar attachment upper aperture (220BEA). The second right bar attachment upper aperture (220BEA) functions to secure the second right bar attachment (220BE) to the second elastic member (16B). The second right bar attachment (220BE) further comprises a second right bar attachment lower aperture (220BEB) which functions to secure the second right bar attachment (220BE)) to the fourth elastic member (16D).

The second curl adapter (220) further comprises a curl bar (220C). One distal end of the curl bar (220C) is securely attached to the proximal end of the second left bar (220A). The opposite distal end of the curl bar (220C) is securely attached to the proximal end of the second right bar (220B).

Figure 8:
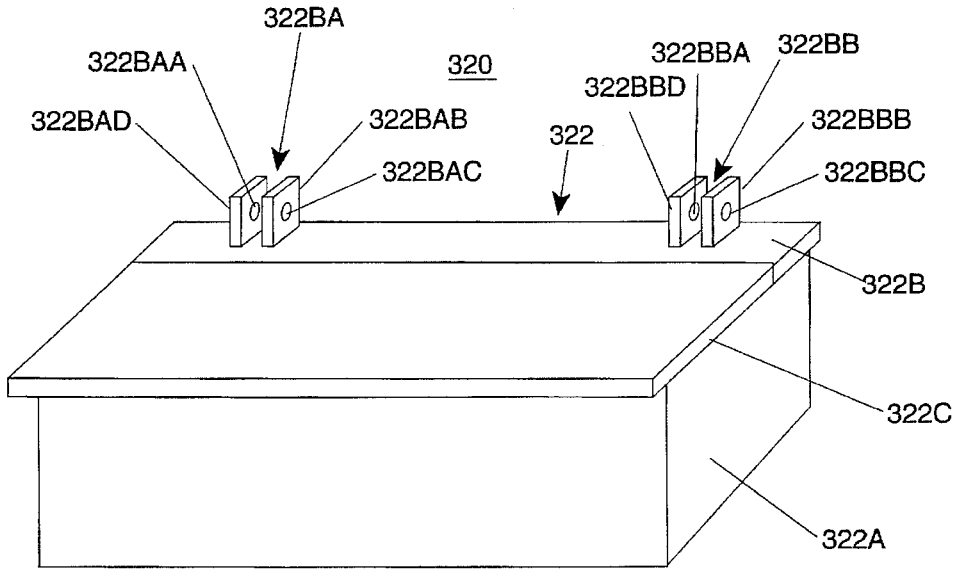
FIG. 8 is a perspective view of a third storage box.

Finally referring to FIG. 8 which is a perspective view of a third storage box exhibiting the following features: third storage box (322), third container (322A), third top (322B), third left attachment (322BA), third left attachment left tab (322BAA), third left attachment right tab (322BAB), third left attachment left tab aperture (322BAC), third left attachment right tab aperture (322BAD), third right attachment (322BB), third right attachment left tab (322BBA), third right attachment right tab (322BBB), third right attachment left tab aperture (322BBC), third right attachment right tab aperture (322BBD), and third lid (322C).

A third storage box (322) comprises a third container (322A) securely attached to a third top (322B). The third top (322B) comprises a third left attachment (322BA) having a third left attachment left tab (322BAA) and a third left attachment right tab (322BAB) securely attached thereto. The a third left attachment left tab (322BAA) comprises a third left attachment left tab aperture (322BAC). The third left attachment right tab (322BAB) comprises a third left attachment right tab aperture (322BAD).

The third top (322B) further comprises a third right attachment (322BB). The third right attachment (322BB) comprises a third right attachment left tab (322BBA) and a third right attachment right tab (322BBB) securely attached thereto. The third right attachment left tab (322BBA) comprises a third right attachment left tab aperture (322BBC). The third right attachment right tab (322BBB) comprises a third right attachment right tab aperture (322BBD).

The third right attachment (322BB) and a third left attachment (322BA) function together to attach the third storage box (322) to the wall mount (12).

The third top (322B) is rotationally attached to a third lid (322C).

It will be understood that each of the elements described above, or two or more together, may also find an useful application in other types of constructions differing from the type described above.

While the invention has been illustrated and described as embodied in a Wall Mounted Exercise Unit, it is not intended to be limited to the details shown, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

What is claimed is:

1. A wall mount exercise unit (10) comprising:

A) a wall mount (12) comprises a wall mount left channel (12L) and a wall mount right channel (12R) which are securely attached to a wall with spacing complementary to a structural members located within the wall, the wall mount (12) functions to support adapters that facilitate exercising by an user, the wall mount left channel (12L) comprises a wall mount left channel front left member (12LAB) perpendicularly attached to one distal end of a wall mount left channel left side member (12LAC), an opposite distal end of the wall mount left channel left side member (12LAC) is perpendicularly attached to one distal end of a wall mount left channel back member (12LAD), an opposite distal end of the wall mount left channel back member (12LAD) is perpendicularly attached to one distal end of a wall mount left channel right side member (12LAE), an opposite distal end of the wall mount left channel right side member (12LAE) is attached perpendicularly to one distal end of a wall mount left channel front right member (12LAF), the wall mount right channel (12R) comprises: a wall mount right channel top (12RA) and a wall mount right channel bottom (12RB) securely fastened to a wall at a spacing complementary to the hidden structural members of the wall, the wall mount right channel top (12RA) and wall mount right channel bottom (12RB) are sized to fit within the third storage box (322) for shipping, the wall mount right channel front left member (12RAB) is perpendicularly attached to one distal end of a wall mount right channel left side member (12RAG), an opposite distal end of the wall mount right channel left side member (12RAC) is perpendicularly attached to one distal end of a wall mount right channel back member (12RAD), an opposite distal end of the wall mount right channel back member (12RAD) is perpendicularly attached to one distal end of a wall mount right channel right side member (12RAE), an opposite distal end of the wall mount right channel right side member (12RAE) is attached perpendicularly to one distal end of a wall mount right channel front right member (12RAF);

B) at least one universal block (14) which is slidably and security attached within the wall mount (12), the at least one universal block (14) is selected from a group consisting of first universal block (14A), second universal block (14B), third universal block (14C), fourth universal block (14D), fifth universal block 14E, sixth universal block 14F, seventh universal block 14G, eighth universal block 14H, ninth universal block 141, and tenth universal block 14J), the universal block (14) functions to attach an adapter means and an elastic means to the wall mount (12), the first universal block (14A) comprises a first universal block cube top face (14AA) attached perpendicularly to a first universal block cube side face (14AB) which has a first universal block cube aperture (14AC) centrally located and passing through to the opposite side, the first universal block cube side face (14AB) is further attached to a first universal block cube front face (14AD) along the front edge, the first universal block cube from face (14AD) has a first universal block tab (14AE) attached perpendicularly, along the central vertical line, the first universal block tab (14AE) protrudes through the wall mount left channel slot (12LAA) functioning to permit attachment of adapters to a first universal block tab aperture (14AG), the first universal block (14A) is secured within the wall mount left channel (12L) by a first universal block clevis pin (14AH) passing through the wall mount left channel aperture (12LAG) and the universal block tab aperture (14AG), the first universal block clevis pin (14AH) comprises a first universal block clevis pin head (14AHA) securely attached to one distal end of a first universal block clevis pin shaft (14AHB), an opposite distal end of the first universal block clevis pin shaft (14AHB) has a first universal block clevis pin aperture (14AHC) functioning to removably secure a first universal block retaining pin (14AHD) which prevents the first universal block clevis pin (14AH) from inadvertently dislodging.

2. The wall mount exercise unit (10) as described in claim 1, wherein the elastic means is a first elastic member (16A) having a first elastic member universal block fastener (16AA) functioning to attach the first elastic member (16A) to the first universal block (14A), the first elastic member universal block fastener (16AA) is securely attached to one distal end of a first elastic member first elastic (16AB), an opposite distal end of the first elastic member first elastic (16AB) is securely attached to a first elastic member adapter fastener (16AC), a first elastic member first elastic (16AB) functions to provide resistance to an user while using an adapter means, the first elastic member adapter fastener (16AC) functions to attach the first elastic member (16A) to the first universal block (14A).

3. The wall mount exercise unit (10) as described in claim 1, wherein the adapter means is a first pull adapter (118A) securely attached to the wall mount (12), the first pull adapter (118A) comprises a first handle (118AA) which comprises a first handle left member (118AAA) securely attached to a first handle transverse member (118AAB), the first handle transverse member (118AAB) is securely attached to a first handle right member (118AAC), the first handle right member (118AAC) is securely attached to a first handle grip (118AAD), the first handle transverse member (118AAB) is further attached to a first handle cable connector (118AAE) which is securely attached to one distal end of a first cable (118AB), an opposite distal end of the first cable (118AB) is securely attached to a first eye (118AC), the first eye (118AC) functions to attach the first pull adapter (118A) to a seventh first universal block (14G).

4. The wall mount exercise unit (10) as described in claim 1, wherein the adapter means is a second pull adapter (118B) securely attached to a wall mount (12), the second pull adapter (118B) functions in conjunction with the first pull adapter (118A) to permit an user to exercise both arms simultaneously.

5. The wall mount exercise unit (10) as described in claim 1, wherein the adapter means is a second curl adapter (220) rotationally attached to a wall mount (12), the second curl adapter (220) comprises a second left bar (220A) which is securely attached at one distal end to a proximal end of a second left bar transverse member (220AA), a distal end of the second left bar transverse member (220AA) is securely attached to a proximal end of a second left bar left member (220AB), the second left bar (220A) has a second left bar aperture (220AC), the second left bar left member (220AB) has a second left bar left member aperture (220AD), the second left bar aperture (220AC) and second left bar left member aperture (220AD) function to rotatably and removably secure the second left bar (220A) to the third universal block (14C) by the first universal block clevis pin (14AH), the second left bar (220A) comprises a second left bar attachment (220AE) having a second left bar attachment upper aperture (220AEA) therein, the second left bar attachment upper aperture (220AEA) functions to secure the second left bar attachment (220AE) to the first elastic member (16A), the second left bar attachment (220AE) has a second left bar attachment lower aperture (220AEB) therein, which functions to secure the second left bar attachment (220AE) to a third elastic member (16C), the second curl adapter (220) further comprises a second right bar (220B) which is perpendicularly attached to a proximal end of a second right bar transverse member (220BA), a distal end of the second right bar transverse member (220BA) is securely attached to a proximal end of a second right bar left member (220BB), the second right bar (220B) has a second right bar aperture (220BC) therein, the second right bar left member (220BB) has a second right bar left member (220BD) therein, the second right bar aperture (220BC) and second right bar left member (220BD) functions to rotatably and removably secure the second right bar (220B) to a fourth universal block (14D) by the first universal block clevis pin (14AH), the second right bar (220B) comprises a second right bar attachment (220BE) which has a second right bar attachment upper aperture (220BEA) which functions to secure the second right bar (220B) to a second elastic member (16B), the second right bar attachment (220BE) further has a second right bar attachment lower aperture (220BEB) therein which functions to secure the second right bar (220B) to a fourth elastic member (16D), the second elastic member (16B) and the fourth elastic member (16D) function to provide resistance to a user.

6. The wall mount exercise unit (10) as described in claim 1, wherein the adapter means is a third storage box (322) securely attached to a wall mount (12), the third storage box (322) comprises a third container (322A) securely attached to a third top (322B), the third top (322B) has a third left attachment (322BA) and a third right attachment (322BB), the third left attachment (322BA) comprises a third left attachment left tab (322BAA) and a third left attachment right tab (322BAB) securely attached thereto, the third left attachment left tab (322BAA) has a third left attachment left tab aperture (322BAC) therein, the third left attachment right tab (322BAB) has a third left attachment right tab aperture (322BAD) therein, the third top (322B) further comprises a third right attachment (322BB), the third right attachment (322BB) comprises a third right attachment left tab (322BBA) and a third right attachment right tab (322BBB) securely attached thereto, the third right attachment left tab (322BBA) has a third right attachment left tab aperture (322BBC) therein, the third right attachment right tab (322BBB) has a third right attachment right tab aperture (322BBD) therein, the third right attachment (322BB) and a third left attachment (322BA) function together to attach the third storage box (322) to the wall mount (12), the third top (322B) is rotationally attached to a third lid (322C).

7. The wall mount exercise unit (10) as described in claim 6, wherein the third storage box (322) functions as a shipping container for the wall mount exercise unit (10).

8. The wall mount exercise unit (10) as described in claim 6, wherein the third storage box (322) functions as a seat for the user while using an adapter selected from a group of adapters comprising; first pull adapter (118A), second pull adapter (118B), and second curl adapter (220).

9. The wall mount exercise unit (10) as described in claim 1, wherein the wall mount left channel (12L) comprises sections suitablely sized to be stored within the third storage box (322).

10. The wall mount exercise unit (10) as described in claim 1, wherein the wall mount right channel (12R) comprises sections suitably sized to be stored within the third storage box (322).

* * * * *